United States Patent [19]

Cooke

[11] Patent Number: 4,756,488

[45] Date of Patent: Jul. 12, 1988

[54] REEL CORE

[75] Inventor: Donald R. Cooke, Fridley, Minn.

[73] Assignee: Liberty Diversified Industries, Minneapolis, Minn.

[21] Appl. No.: 909,902

[22] Filed: Sep. 22, 1986

[51] Int. Cl.[4] ..... B65H 75/22

[52] U.S. Cl. ..... 242/116

[58] Field of Search ..... 242/115, 116, 118.6, 242/71.8

[56] References Cited

U.S. PATENT DOCUMENTS

| | | | |
|---|---|---|---|
| 1,316,972 | 9/1919 | Prentiss | 242/116 |
| 1,837,237 | 12/1931 | Shangle | 242/116 |
| 2,781,985 | 2/1957 | Hoffstedt | 242/118.6 |
| 4,053,120 | 10/1977 | Frantzreb | 242/115 |
| 4,316,589 | 2/1982 | Stranders | 242/71.8 |

FOREIGN PATENT DOCUMENTS

| | | | |
|---|---|---|---|
| 354240 | 6/1922 | Fed. Rep. of Germany | 242/118.6 |
| 1411065 | 8/1965 | France | 242/71.8 |
| 346737 | 10/1929 | United Kingdom | 242/71.8 |

*Primary Examiner*—John M. Jillions

*Attorney, Agent, or Firm*—Moore & Hansen

[57] ABSTRACT

A reel core having a molded hub section of generally cylindrical shape including a barrel surface upon which rope-like articles may be wound or coiled and end flanges. The hub section has an axle bore to receive an axle upon which the reel core is rotated. At each end of the hub section is a flange mounting rim comprised of two thin rim walls spaced apart the thickness of the flange material. Each outer rim wall has a rim notch. Each flange has an aperture including a notch corresponding to the notch on the flange mounting rim. The inner edge of the aperture adjacent to the notch is inserted into the rim notch of the mounting rim from one direction, and rotated in that same direction to mount the flanges within the rim. A variety of sizes, shapes, and materials may be used to form the flanges, which may be selectively attached or removed.

21 Claims, 3 Drawing Sheets

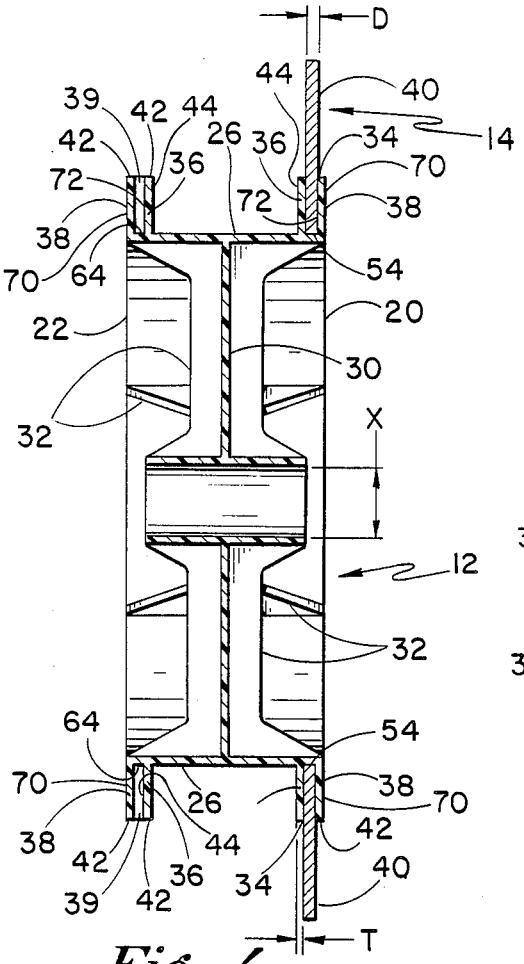
Fig.-4
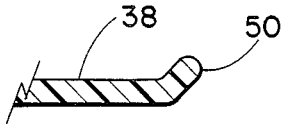
Fig.-5
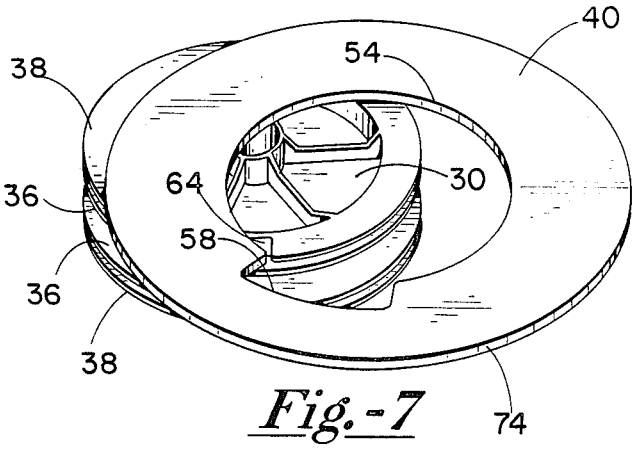
Fig.-7
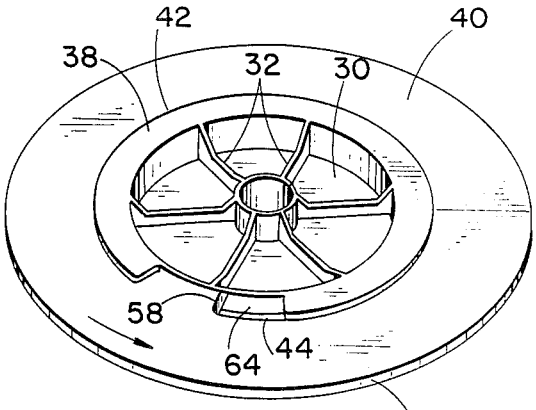
Fig.-8
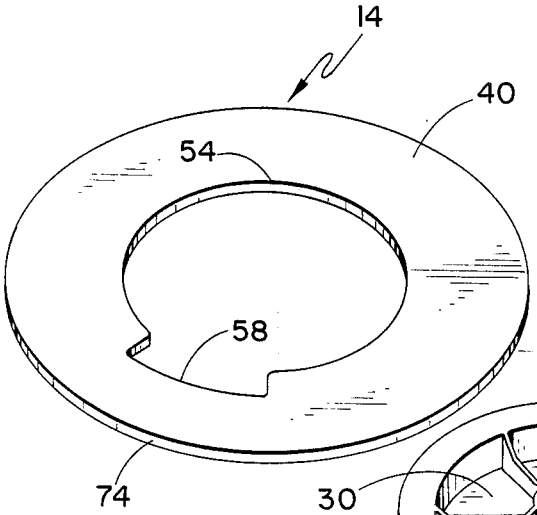
Fig.-6
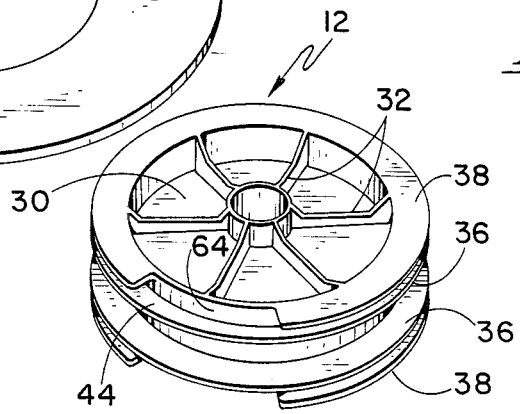

REEL CORE

BACKGROUND OF THE INVENTION

This invention relates to reel cores for winding lengths of wire, cord, tubing, or similar rope-like articles thereon to be stored, transported, or dispensed. More particularly, this invention relates to reel cores having central hub sections with end flanges to retain the rop-like material wound on the barrel surface of the hub section.

Reels may range in size from several feet in diameter and weighing several hundred pounds for use in holding coils of steel suspension or electrical cable, down to fractions of an inch in diameter and fractions of an ounce in weight for holding thread, ribbon, or tape.

U.S. Pat. No. Des. 200,936 discloses a conventional reel assembly used with magnetic recording tape. The patent shows a central hub section and two end flanges located at each end thereof, with each end flange having a substantially greater diameter than the central hub. The central hub has an axle bore through its center as well as three equilaterally spaced drive-sprocket apertures. The end flanges are molded as unitary components of the central hub. The tape is wound onto the barrel surface of the reel hub between the flanges and tangentially to the barrel surface as the hub is rotated at moderate to high speeds. The flanges taper inwardly so that each layer is aligned uniformly to prevent stress and friction. To wind some products onto larger reels at slower speeds, however, it is more practical to coil the product onto the reel core by laying the product onto a horizontal flange and around the hub from the side, and then later attached the second flange.

Typical reel assemblies may be as simple as a wooden spool for sewing thread, or more complex, such as the reel hub contained in the video tape cannister disclosed in U.S. Pat. No. 3,154,193 in which the end flanges are also the sides of the cannister and the central hub serves as a high impact locking mechanism to secure the cannister together into a dust-tight, shock-proof container.

Reels are a particularly useful and inexpensive means for storing, transporting, and dispensing many items such as wire, cable, rope, cord, plastic and metal tubing, hose, adhesive or non-adhesive tapes, webbing, ribbon, and the like. The reels upon which these products are delivered, marketed, and subsequently dispensed often dually serve as take-up reels to collect the continuous lengths of such rope-like products as they are being manufactured.

For wire and tubing products, cardboard or fiberboard flanges are usually stapled, glued, or fastened with tabs to aluminum, wood, or plastic hubs. In some instances, the hub portion itself is formed from the same sheet material as the flanges, with flaps extending from the ends of the hub which are inserted through slots in the flanges, folded over, and fastened. It is sometimes more practical to enclose the hub inside a cardboard carton which will also function as the display packaging and dispenser. Depending upon whether the product is to be wound onto the face of the rotating hub or coiled from the side, one or both flanges or the carton may be attached before or after the product has been placed on the reel hub.

Despite the wide variety of reel designs, the great number of different uses to which reels are applied, and the total number of those reels which are currently in use at any given time, there remain some significant problems and limitations common to existing reel designs.

As they are currently manufactured, inexpensive reels used for collecting and dispensing electrical wire and other building materials are generally treated as being disposable. Although they function both as takeup reels, packaging cartons, and dispensers, they are designed to function with only one type, size, and character of product. In that respect, they cannot be considered reusable, multifunctional, or capable of interchangable uses. Because they are not designed to be reused, they are not readily refillable with new product or with a product different than the original, and they are often not strong enough to be used repeatedly. The packaging cartons may often be damaged or rendered unusable when they are opened, or refilling the reel might require destroying the packaging carton to gain access to the reel hub. If a wood, plastic, or metal hub is used, this disposability of the reel hub becomes wasteful.

The flanges may not be replaced separately if they become damaged. They interfere with attempts to smoothly remove the rope-like product from the side of the hub, particularly when the reel is laid horizontally on the ground and the user must occupy both hands working with the product. Also, the flanges are generally of one fixed size, shape, and material which cannot be varied by the user. Furthermore, both flanges on the reel are generally of the same type and size. If the original quantity of product is great and the flanges are acordingly large, the user is faced with carrying, handling, and storing the large flanged reel even when only a small amount of product remains on the reel.

BRIEF DESCRIPTION OF THE INVENTION

Therefore, it is one object of this invention to design a reel core which may be reused with several different rope-like products.

It is a further object of this invention to design the above reel core such that product may be wound onto the surface of the hub from between the flanges as the hub is rotated, or coiled onto the hub from the side.

In this respect, an additional object of this invention is to design the above reel core so that a user may alternately choose to deploy the rope-like product by placing the reel core on an axle and rotating the hub, or by removing the product from the side of the hub without interference from the flange.

It is another object of this invention to design the above reel core such that several different flanges may be used with the same hub, those flanges varying in size, shape, and material depending upon the particular application. For example, in one application, the reel core might have circular flanges for winding and deploying the product, but one or both of those flanges would be replaced by square flanges when the user desired to set the reel down without having it roll or deploy excess product. In another example, flanges of a thin, lightweight, single-layer cardboard would be used to ship and sell the product, and the user would replace those flanges with thicker and more durable corrugated plastic flanges which could be used repeatedly.

It is an attendant object of this invention to permit the user to vary the overall size of the reel to accomodate the amount of product remaining on the reel as the product is depleted or refilled.

It is an object of this invention to provide the user of the above reel core the opportunity to use different sizes and types of flanges on the reel at the same time, or to selectively alternate those flanges while the reel hub is in use.

It is a further object of this invention to design the above reel core such that the different flanges may be quickly and easily attached to the reel hub without fasteners or tools, and removed from the reel hub by hand with equal speed and ease.

It is still another object of this invention to design the above reel core such that the flanges may be interchangable and reusable, or disposable when necessary, while the reel core itself may be used repeatedly for an indefinite period.

It is yet another object of this invention to design the above reel core such it may be used as a take-up reel and storage reel, with separate flanges which contain advertising, source of origin, or purchase information provided to attach prior to display or sale of the reel.

An additional object of this invention is to design the above reel core such that the flanges may alternately bear advertising, promotional, instructional, or identification markings may be selectively and alternatively substituted for conventional flanges.

Briefly described, the reel core of this invention has a molded central hub section of generally cylindrical shape including a barrel surface upon which rope-like articles may be wound or coiled. The hub section has an axle bore extending entirely therethrough along the axis of rotation of the hub section. Extending radially outward from the barrel surface of the hub section at each end thereof is a flange mounting rim having two thin rim walls spaced apart the thickness of the flange material. The outer wall of the rim has a rim notch extending inwardly and terminating at the hub surface. A flange having an aperture generally greater in diameter than that of the hub section and smaller in diameter than that of the mounting rims, and including a notch corresponding to the notch on the flange mounting rims, is mounted upon each mounting rim. The inner edge of the aperture of the flange adjacent to the notch is inserted into the rim notch of the flange mounting rim from one direction, and the flange is rotated continuously in the same direction to mount the flange within the rim. A variety of sizes, shapes, and materials may be used to form the flanges, which may be selectively attached or removed.

These and other objects and advantages will become apparent when reading the following detailed description in light of the accompanying drawings, in which reference numerals indicate like elements throughout.

DESCRIPTION OF THE DRAWINGS

FIG. 4 is a cross sectional view of the reel core taken through line 4—4 in FIG. 2;

FIG. 5 is a cross sectional view of the rim lip taken in the direction indicated through line 5 in FIG. 2;

FIG. 6 is a perspective view of the reel core of this invention with the flange being positioned above the hub section for mounting thereon;

FIG. 7 is a perspective view of the reel core of this invention with the flange partially inserted in the mounting rim of the reel core with the arrow showing the direction of rotation of the flange for mounting;

FIG. 8 is a perspective view of the reel core of this invention with the flange mounted thereon;

DESCRIPTION OF THE PREFERRED EMBODIMENTS

The reel core of this invention is shown in FIGS. 1–12 and referenced generally by the numeral 10.

Figure 1:
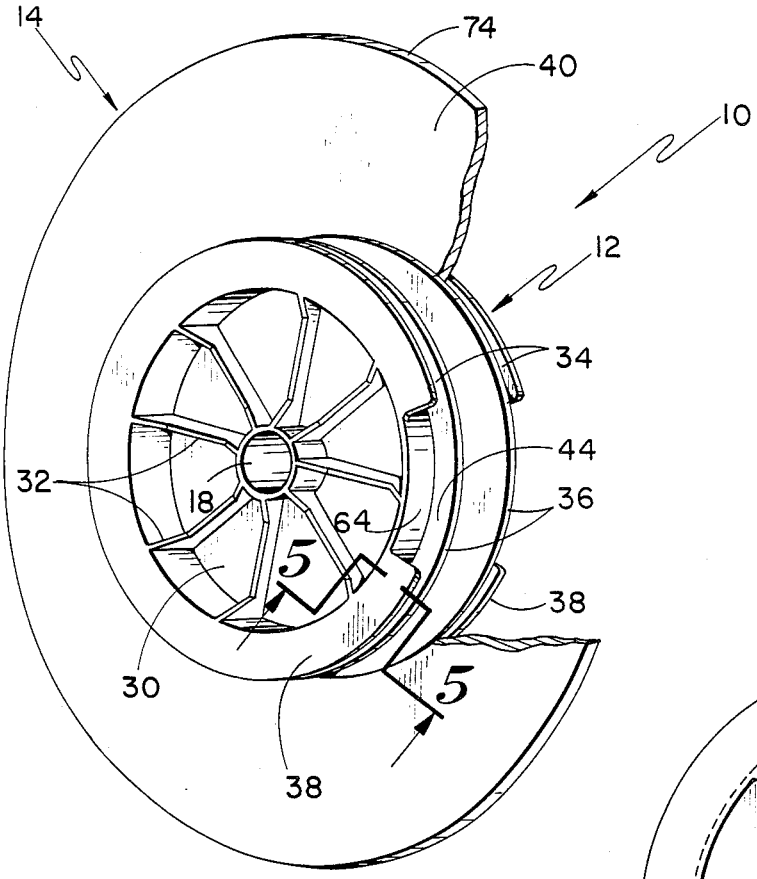
FIG. 1 is a perspective view of the reel core of this invention with a flange attached to one mounting rim.

Referring to FIG. 1, the reel core 10 is comprised of a central hub section 12 and one or more flange assemblies 14.

Figure 2:
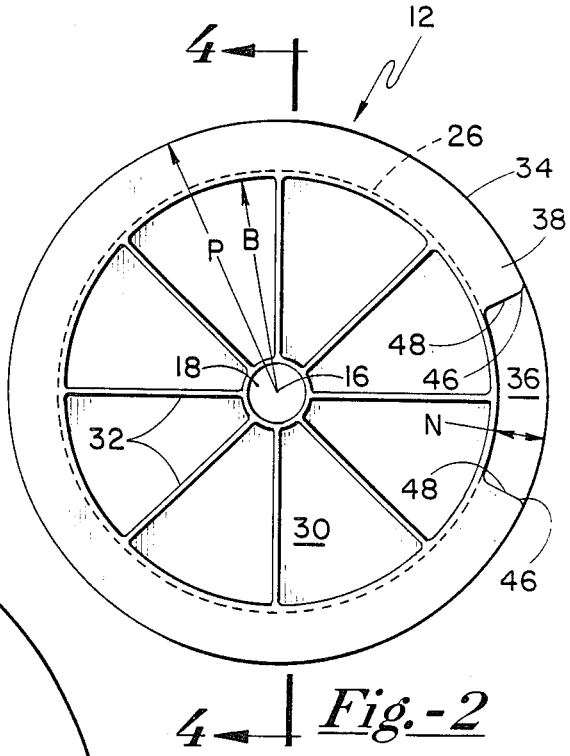
FIG. 2 is an oblique side view of the reel core of FIG. 1.

As seen in FIGS. 2 and 4, the hub section 12 is molded from any one of several high impact resistant plastics. The hub section 12 preferably has a generally cylindrical shape and circular cross section, although any cross sectional shape desired may be selected including triangular, square, hexagonal, or octagonal.

The hub section 12 has an axis of rotation 16, and an axle bore 18 of generally circular cross section extending entirely through the hub section 12 from a first end 20 to a second end 22 of the hub section 12, and centered along the axis of rotation 16. The axle bore 18 should have a diameter X sufficient to receive and accomodate an axle 24 upon which the reel core 10 would be rotated. The axle 24 may be any one of a variety likely to be encountered, such as that on a take-up or winding machine, a display or sales rack, or used in the anticipated working environment of the reel core 10. The axle bore 18 may be given an elliptical or oblong cross section, or may be off-centered from the axis of rotation 16, to prevent the hub section 12 from rotating on the axle 24 unless the necessary measure of force is applied. If desired, more than one axle bore 18 may be provided, both centered and off-centered relative to the axis of rotation 16. It may also be desirable in some applications to have the axle bore 18 extend partially through the internal body 30, so that an axle 24 may be received into the axle bore 18 a given distance, but the reel core 10 will not completely slide over the axle 24.

The hub section 12 has a barrel surface 26 upon which a rope-like product 28 may be wound. The barrel surface 26 may be smooth, textured, or grooved. It may contain slots, notches, holes, hooks, or other devices to attach or anchor the product 28 to the reel core 10 depending upon the nature of the product 28 and the intended uses of the reel core 10.

The internal body 30 of the hub section 12 between the axle bore 18 and the barrel surface 26 may be of solid construction, or comprise any number of supporting members 32 such as vanes, ribs, or spokes. The supporting members 32 may be molded as integral parts of the reel core 10 in order to reduce the volume of material and the overall weight of the reel core 10 without detriment to the strength or structural integrity of the reel core 10. The supporting members 32 may also be used as handles to turn the reel core 10 upon an axle 24, and may be modified to function as carrying handles, to contain cutting or fastening implements, or to secure the free end of the product 28.

The diameter X of the axle bore 18 may also be made so large that twice the radius B of the barrel surface 26 differs from the diameter X of the axle bore 18 by only twice the thickness of the plastic used to form the internal body 30 of the hub section 12. Such a configuration would conform to several current reel designs wherein the hub section 12 is constructed of a thin metal sheet rolled into a cylinder and crimped, and the flange assemblies 14 are rigid plastic.

The reel core 10 has a mounting rim 34 located at each of the ends 20, 22 of the hub section 12. The mounting rims 34 are each comprised on an inner rim wall 36 and an outer rim wall 38 which extend radially outward from the barrel surface 26 generally parallel to one another, and around the barrel surface 26 of the hub section 12 to form a continuous channel 39 or track. Each pair of rim walls 36, 38 should be spaced apart a distance D approximately equal to the thickness of the material used to form the flange 40 such that the flange 40 may be slidably yet firmly received and mounted between the rims walls 36, 38 and within the channel 39. The rim walls 36, 38 are molded integrally with the reel core 10 and preferably have a relatively thin wall thickness T relative to their spacing distance D.

The radius P of the perimeter edge 42 of the rim walls 36, 38 should be sufficiently greater than the radius B of the barrel surface 24 such that the flanges 40 may be securely held in place between the rim walls 36, 38 when subjected to a strong lateral force or torque, but not so much greater than the radius B of the barrel surface 24 as to interfere with coiling or deploying the product 28 when the flange 40 is not mounted on the reel core 10.

Figure 3:
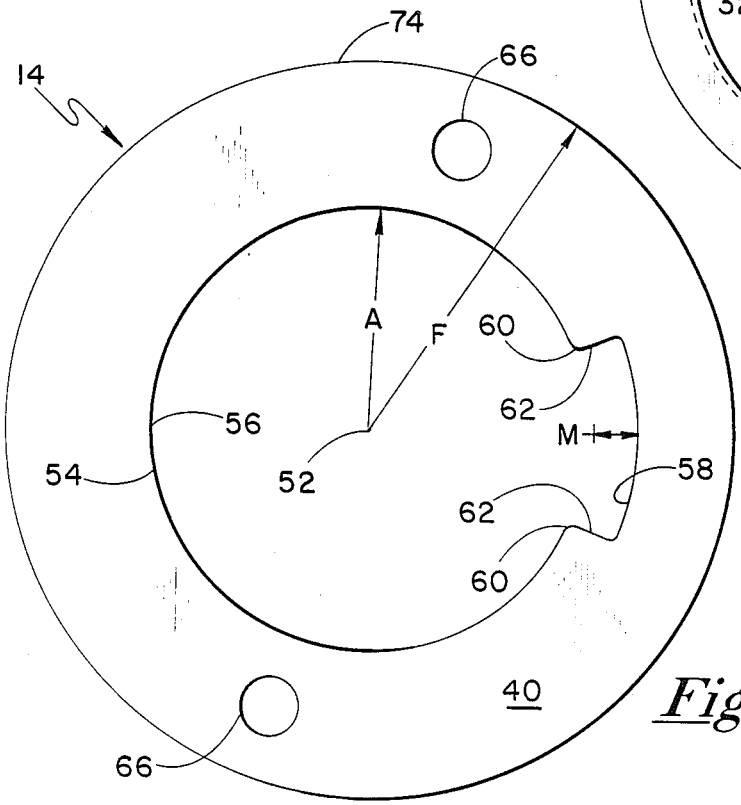
FIG. 3 is a plan view of the circular embodiment of the flange used with the reel core of this invention.

As seen n FIG. 3, a section of each outer rim wall 38 is cut away radially inward from the perimeter edge 42 to the barrel surface 26 to form a rim notch 44 having a depth N. The rim notch 44 preferably extends over approximately one-eighth the circumference of the perimeter edge 42 of the reel core 10, and may be located at any position along the perimeter edge 42.

The corners 46 of the rim notch 44 may be rounded, and one or both side edges 48 of the rim notch may have an outwardly projecting lip 50 as shown in FIG. 5. This lip 50 may be used to aid in mounting the flange 40 as explained in greater detail below.

The flanges 40 may be cut or stamped from a blank of any flexible but resilient sheet material such as corrugated cardboard, fiberboard, or plastic, although corrugated plastic has proven particularly suitable. The material used to make the flanges 40 should have a thickness approximately equal to that of the spacing distance D between the inner and outer rim walls 36, 38 respectively, so that the resulting flange 40 has a thickness less than or substantially comparable to the distance D which the rim walls 36, 38 are spaced apart.

The flanges 40 are generally planar, and should be resilient enough to return to and retain that generally plan form after being flexed or bent. Each flange 40 may have any desired shape, although a circular shape is conventional. Such a circular flange 40 would have a center point 52 and an outer flange radius F measured from the center point 52. Each flanges 40 has a circular mounting aperture 54 with a radius A slightly greater than or equal to the radius B of the barrel surface 24, but less than the radius P of the perimeter edge 42 of the rim wall 38. The inner edge 56 of the mounting aperture 54 also defines a flange notch 58 which extends into the flange 40 in a direction away from the mounting aperture 54 and center point 52 a distance approximately equal to the difference between the raduis P of the perimeter edge 42 of the rim wall 38 and the radius B of the barrel surface 24. Thus, the depth M of the flange notch 58 is substantially the same as the depth N of the rim notch 44. The flange notch 58 preferably extends over approximately one-eighth the circumference of the mounting aperture 54, and may be located at any position along the inner edge 56.

The corners 60 of the flange notch 58 may be rounded, and the side edges 62 of the flange notch 58 may be tapered and beveled to facilitate mounting the flange 40 between the rim walls 36, 38.

Extending between the rims walls 36, 38 within the channel 39 is a track surface 64. In this embodiment of the reel core 10, the track surface is comprised of the barrel surface 26. The rim notch 44 should extend radially inward from the perimeter edge 42 and terminate at a point substantially at the level of the track surface 64, although it may be desirable to recess the rim notch 44 further, or leave the rim notch 44 extending slightly outward of the track surface 64.

The process for mounting a flange 40 onto the hub section 12 is shown in FIGS. 6–8. The flange 40 is first placed in parallel, overlapping relationship to one of the ends 20, 22 of the hub section 12. One of the corners 60 of the flange notch 58 is aligned with the rim notch 44 in the outer rim wall 38, and the side edge 62 of the flange notch 58 adjacent to that corner 60 is inserted through the rim notch 44 and between the rim walls 36, 38. The inner edge 56 of the mounting aperture 54 adjacent the corner 60 which is inserted should be in close proximity to, or in contact with, the track surface 64 of the channel 39. As the flange 40 is further inserted into the channel 39, the surface of the flange 40 will be substantially parallel to and abutting the outer surface 70 of the outer rim wall 38 on one side of the rim notch 44, and substantially parallel to and abutting the inner surface 72 of the outer rim wall 38 on the opposing side of the rim notch 44, and will pass diagonally through the rim notch 44 at an angle defined by the width of the rim notch 44 and the thickness of the outer rim wall 38. In this manner, a portion of the flange 40 is considered threaded onto the mounting rim 34. Continuing to turn the flange 40 in the same direction as the corner 60 was inserted, the flange 40 is rotated approximately one complete revolution. This process carries the inner edge 56 of the mounting apertures 54 entirely into the channel 39, and thus securely mounts the flange 40 within the mounting rim 34. Once the flange 40 has been completely threaded onto the mounting rim 34 in the above described fashion, it may then be allowed to rotate freely within the mounting rim 34, or may be held in place by friction or a fastener if desired.

It is understood that the flange notch 58 and rim notch 44 may be made symmetrical so that the flange 40 can be mounted by rotation in either the clockwise or counter-clockwise direction depending upon the orientation of the side edge 62 which was selected to be inserted into the rim notch 44.

Corrugated plastic and cardboard have proven suitable materials for the flange 40 because each has sufficient flexibility to permit the corner 60 to be inserted into the rim notch 44 by flexing the flange 40, yet each retains a degree of rigidity such that the flange 40 will remain within the mounting rim 34 when rotated and will hold its generally planar form. To facilitate rotating the flange 40, each flange 40 may have one or more orifices 66 or apertures large enough for the user to insert a finger, rod-like article, or tool and rotate the flange 40.

Removing the flange 40 from the hub section 12 is accomplished by reversing the mounting process. The flange 40 is rotated in either the clockwise or counter-clockwise direction until one of the corners 60 is between the side edges 48 of, and exposed by, the rim notch 44. The flange 40 is then flexed and rotated such that the corner 60 bends outwardly through the rim notch 44 and outside of the channel 39. As the flange 40 continues to be rotated, that corner 60 passes along the outside surface of the outer rim wall 38, with the inner edge 56 of the mounting aperture 56 trailing. Rotating the flange 40 at least one complete revolution removes the flange 40 from the mounting rim 34.

Figure 9:
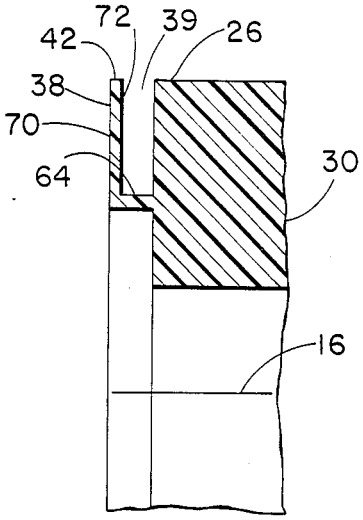
FIG. 9 is a cross sectional view of one embodiment of the reel core of this invention in which the mounting rims have a smaller radius relative to the axis of rotation than the barrel surface.
Figure 11A:
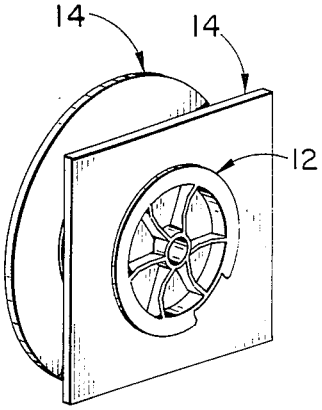
FIG. 11*a* is a perspective view of the reel core having a square and circular flange attached.
Figure 11B:
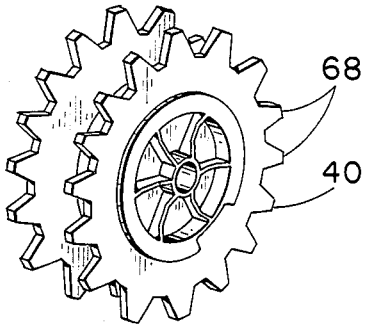
FIG. 11*b* is a perspective view of the reel core having gear shaped flanges attached.
Figure 11C:
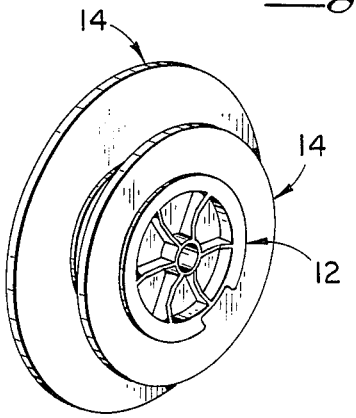
FIG. 11*c* is a perspective view of the reel core having circular flanges of differing diameters attached.
Figure 11D:
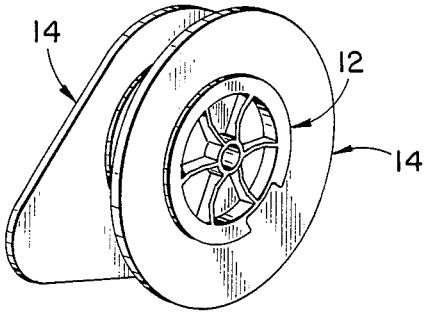
FIG. 11*d* is a perspective view of the reel core having an elliptical and circular flange attached.
Figure 12:
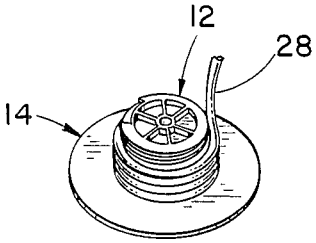
FIG. 12 is a perspective view of the reel core with one flange removed with product being coiled or uncoiled from the side of the hub.

Another embodiment of the reel core 10 having particular advantages including increased lateral support of the flange 40 is shown in FIG. 9. In this embodiment, the mounting rim 34 is comprised of only the outer rim wall 38, with the internal body 30 of the hub section 12 functioning in place of the inner rim wall 36. The track surface 64 may be molded integrally with the internal body 30 and extend longitudinally outward from each end 20, 22 of the hub section 12. The outer rim walls 38 may then be directly connected to the track surface 64 on the side opposing the internal body 30, and extended radially outward from the track surface 64. Consequently, each channel 39 is positioned so that the track surfaces 64 are located radially between the axle bore 18 and the barrel surface 26. The track surfaces 64 extend outwardly from the ends 20, 22 of the internal body 30 of the hub section 12 approximately at a right angle at any point, and the outer rim walls 38 extend radially outward generally perpendicular to the track surfaces 64. The outer rim walls 38 have rim notches 44 as in the previous embodiment.

This embodiment is particularly useful when the radius B of the barrel surface 26 need not be kept to a minimum, and where maximum lateral support of the flanges 40 is desired. To obtain even greater lateral support, the radius P of the perimeter edge 42 of the outer rim walls 38 may be increased, even to the point where the radius P of the perimeter edge 42 is equal to or greater than the radius B of the barrel surface 26.

Figure 10:
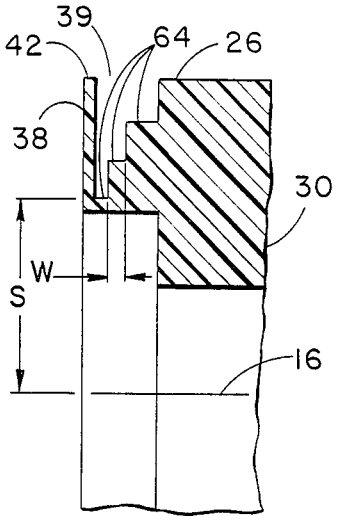
FIG. 10 is a cross sectional view of one embodiment of the reel core of this invention having three track surfaces of varying widths and radii.

Another embodiment of the reel core 10 particularly suited for use with several flanges 40 constructed of different types and thicknesses of material is shown in FIG. 10. In this embodiment, the channel 39 contains a plurality of track surfaces 64. The diameter S and width W of each track surface 64 are varied to accomodate a particular radius A for that mounting aperture 54 and thickness of flange material. In most applications, this embodiment functions optimally with the radii S and widths W of each track surface 64 both decreasing as one moves from the inner rim walls 36 or internal body 30 toward the outer rim walls 38. In this manner, a single layer cardstock flange 40 comprised of the smallest thickness of material and the smallest radius mounting aperture 54, a fiberboard or cardboard flange 40 having an intermediate thickness with an intermediate raduis mounting aperture 54, and a corrugated plastic flange 40 having the largest thickness and largest radius mounting diameter 54, could all be mounted within the same channel 39 and would afford each the maximum lateral support. By having the widths W decrease as one decreases the radius S of the track surface 64, both the radius S and width W decreasing as one moves from a track surface 64 to the next adjacent track surface 64 located nearer to the outer rim wall 38, there is no risk of a thinner flange 40 slipping outwardly and onto a wider track surface 64 having a smaller radius S, thereby losing the lateral support or the proper radial positioning of the perimeter edge P of the flange 40.

A channel 39 having two track surfaces 64, one of a thin width W for single ply cardstock, and the other width W being substantially thicker for corrugated plastic, provides a useful alternative whereby a manufacturer may attach light weight disposable cardboard flanges 40 for shipping a reel of product to a store, and the store may replace those light flanges 40 with similar flanges 40 displaying its own advertising or sales information, and the store or the purchaser may then later replace the light flanges 40 with durable and reusable corrugated plastic flanges 40 for use. A variety of flanges 40 could be sold along with the reel of product. Conversely, the reels of product, a selection of hub sections 12, and a variety of flanges 40 could each be marketed separately for different applications.

Any imaginable shape or form may be incorporated into the design of the flanges 40. A traditional circular flange 40 would likely be the most versatile for shipping, display, and use. Square, triangular, or hexagonal flanges 40 are particularly suited for situations where the reel core 10 is frequently set down on a surface, particularly with a section of product being handled before being separated from the product remaining on the reel core 10, and it is desired that the reel core 10 not roll unrestrained, or that tension on the free end of the product not deploy additional product. Gear- or sprocket-shaped flanges 40 provide the same advantages as circular flanges 40 as well as some of the anti-rolling characteristics of square, triangular, or hexagonal flanges. The gear or sprocket teeth 68 on these flanges will also function to secure the free end of the product when not in use.

An elliptically-, oblate-, or egg-shaped flange 40 having the flange aperture 54 positioned nearer to one of the foci, or nearer to the outer edge 74 of the flange 40, presents other useful qualities. An elliptical or egg shaped flange 40 has a natural center of rotation in its planar dimensions approximately equal to the location of its center of mass. By displacing the flange aperture 54 from that natural center of rotation, making that flange 40 of a light-weight material having the described shape, and mounting one such flange 40 on a reel core 10 such that the flange 40 may rotate freely upon the mounting rim 34, the reel core 10 will not roll when placed on its side due to the weight of the product 28 and hub section 12 which cause the flange 40 and reel core 10 to act as a pendulum. Yet, the tension of the product 28 being withdrawn from the reel core 10 as it rests on an end 20, 22 opposite the elliptical flange 40 will cause the flange 40 to rotate without interfering with the removal of the product 28.

Different shaped flanges may be used to identify different guages, qualities, types, or materials of product. A coding system unique to each field or industry may be adopted so that its products may be quickly identified at a distance without the necessity of seeing the product or a printed label, such as across a warehouse or in a large construction area. Construction companies and others may incorporate their own markings, designations, or patterns into the flanges 40 to identify and distinguish their materials and supplies from those of other firms, in much the same way that tools and machines are marked. Similarly, production of flanges 40 using specialized materials, such as anti-static coatings or reflectorization, could be incorporated to make the reel cores 10 serve multiple functions.

What is claimed is:

1. A reel core usable with a rope-like product which may be wound or coiled on and unwound or uncoiled from said reel core by a user, and upon which one or more flanges may be removably mounted, each of said flanges defining an aperture having a diameter extending therethrough, said reel core comprising:

a hub section, said hub section having an internal body and a barrel surface surrounding said internal body upon which the rope-like product is wound; and at least one mounting rim extending from and integrally connected to said hub section when the flange is being mounted on the reel core, said mounting rim including an inner rim wall and an outer rim wall, said inner and outer rim walls each extending radially outward from said hub section and each having a perimeter edge and a diameter, the rim walls being spaced apart a distance thereby defining a channel, said channel defining at least one track surface between said inner and outer rim walls, the diameter of said outer rim wall being greater than the diameter of the aperture defined by the flange, the outer rim wall further defining a rim notch, said rim notch extending from said perimeter edge towards and terminating substantially at the level of said track surface, said rim notch having a depth and a width through which at least a portion of the flange adjacent the aperture defined by the flange may by threaded, whereby the flange may be threadingly mounted within the mounting rim between the inner rim wall and the outer rim wall.

2. The reel core of claim 1 further comprising:

one or more flanges, being generally planar and having a thickness less than or substantially comparable to the distance which the rim walls are spaced apart, said flange further defining an aperture extending entirely through the surface of said flange, said aperture having an inner edge and further defining a flange notch, said flange notch having a depth greater than or substantially comparable to the depth of the rim notch, said flange notch further having a side edge extending from said inner edge of said aperture to said depth of said flange notch, whereby the flange notch and the rim notch may communicate so that a portion of the side edge of the flange notch may be received within the rim notch and the flange rotated to thread the flange through the rim notch and thereby mount the flange with in the channel of the mounting rim.

3. The reel core of claim 2, wherein each of the track surfaces have a width, and the thickness of each flange is substantially equal to said width of one of the track surfaces.

4. The reel core of claim 3 wherein the number of track surfaces in each channel is one, and the thickness of the flange is substantially equal to the distance which the rim walls are spaced apart, whereby the flange may contact the inner and outer rim walls.

5. The reel core of claim 2 wherein the track surface has a generally cylindrical shape and generally circular cross section with a track surface radius, and the aperture in the flange has a generally circular shape and an aperture radius substantially equal to the track surface radius.

6. The reel core of claim 1 rotatable upon an axle, said reel core further comprising:

an axle bore extending at least partially through the internal body thereby permitting the reel core to be slidably and rotatably received upon the axle.

7. The reel core of claim 6 wherein the internal body and the barrel surface have a generally cylindrical shape with a substantially circular cross section, the internal body further comprising a plurality of support members extending radially outward between the axle bore and the barrel surface.

8. A reel core usable with a rope-like product which may be wound or coiled on and unwound or uncoiled from said reel core by a user, and upon which one or more flanges may be removably mounted, each flange defining an aperture having a diameter extending therethrough:

a hub section, said hub section having an internal body and a barrel surface surrounding said internal body upon which the rope-like product is wound, said hub section further having a first end and a second end opposing said first end; and at least one mounting rim extending from and integrally connected to said hub section when the flange is being mounted on the reel core, said mounting rim including an outer rim wall and a track surface, said track surface extending a distance longitudinally outward from said internal body, with said outer rim wall extending radially outward from said track surface opposing said internal body, said outer rim wall having a perimeter edge and a diameter, with said outer rim wall, track surface, and internal body defining a channel, the diameter of said outer rim wall being greater than the diameter of the aperture defined by the flange, the outer rim wall further defining a rim notch extending from the perimeter edge towards and terminating substantially at the level of the track surface, said rim notch having a width and depth through which at least a portion of the flange adjacent the aperture defined by the flange may be threaded, whereby the flange may be threadedly mounted within the mounting rim between the internal body and the outer rim wall.

9. The reel core of claim 8 further comprising:

one or more flanges, said flanges being generally planar and having a thickness less than or substantially comparable to the distance between the internal body and the outer rim wall, said flanges further defining an aperture extending entirely through the surface of said flanges, said aperture having an inner edge and further defining a flange notch, said flange notch having a depth greater than or substantially comparable to the depth of the rim notch, said flange notch further having a side edge extending from said inner edge of said aperture to said depth of said flange notch, whereby the flange notch and the rim notch may communicate so that a portion of the side edge of the flange notch may be received within the rim notch and the flanges rotated to thread the flanges through the rim notch and thereby mount the flanges within the channel of the mounting rim.

10. The reel core of claim 8 wherein each of the track surfaces have a width, and the thickness of each flange is substantially equal to said width of one of the track surfaces.

11. The reel core of claim 8 wherein the number of track surfaces in each channel is greater than one, with each of the track surfaces being generally cylindrical in shape and having a substantially circular cross section and a track surface radius, said track surface radius of at least one track surface within the channel being different from said track surface radius of at least one other track surface within the channel.

12. The reel core of claim 11 wherein the track surface radius and the width of the track surface of each track decrease as one moves from the track surface to the next adjacent track surface located nearer to the outer rim wall.

13. The reel core of claim 11 wherein the aperture in each flange is substantially circular and has an aperture radius, said aperture radius being substantially equal to the track surface radius of at least the one of the track surfaces.

14. The reel core of claim 9 wherein the number of track surfaces in each channel is one, and the thickness of the flange is substantially equal to the distance which the outer rim wall is spaced apart from the internal body, whereby the flange may contact the internal body and outer rim wall.

15. The reel core of claim 8 rotatable upon an axle, said reel core further comprising:

an axle bore extending at least partially through the internal body thereby permitting the reel core to be slidably and rotatably received upon the axle.

16. A flange for use with a reel core having a mounting rim, said mounting rim defining a channel having at least one track surface and including an outer rim wall and a rim notch defined by said outer rim wall and having a depth, each said track surface having a width, said flange comprising:

a generally planar flange having a thickness less than or substantially comparable to the width of one of the track surfaces, said flange further defining an aperture extending entirely through the surface of said flange, said aperture having an inner edge and further defining a flange notch said flange notch having a depth substantially comparable to the depth of the rim notch, said flange notch further having a side edge extending from said inner edge of said aperture to said depth of said flange notch, whereby the flange notch and the rim notch may communicate so that a portion of the side edge of the flange notch may be received within the rim notch and the flange rotated to thread the flange through the rim notch and thereby mount the flange within the channel of the mounting rim.

17. The flange of claim 16 wherein the flange is cut from a sheet of corrugated plastic and has a substantially circular shape.

18. The flange of claim 16 which may be rotated by an article such as a finger on a hand, said flange further comprising:

one or more flanges orifices extending entirely through the surface thereof, said flange orifices being capable of slidably receiving the article which rotates the flange.

19. The flange of claim 16 wherein the flange is substantially gear-shaped.

20. The flange of claim 16 wherein the shape of the flange is substantially elliptical and the flange has a natural center of rotation, the flange aperture being generally displaced from the natural center of rotation.

21. In a reel core having a mounting rim and a flange mounted upon said mounting rim, said mounting rim having an outer rim wall and a track surface, the method of mounting said flange upon said rim comprising the steps of:

providing the outer rim wall with a rim notch having a depth;

providing the flange with a flange aperture extending entirely through the surfaces of said flange, said aperture having an inner edge and further defining a flange notch, said flange notch having a depth greater than or substantially comparable to the depth of the rim notch, said flange notch further having a side edge extending from said inner edge of said aperture to said depth of said flange notch;

placing the flange in a substantially parallel and overlapping relation to the outer wall of the mounting rim such that the flange notch and rim notch communicate;

inserting at least a portion of said side edge of the flange notch through said rim notch; and rotating said flange in the direction which said side edge of said flange was inserted through said rim notch until said flange is threaded on said mounting rim.

* * * * *